US012234663B2

(12) United States Patent
Bucarizza

(10) Patent No.: US 12,234,663 B2
(45) Date of Patent: Feb. 25, 2025

(54) DETERRENT MATERIAL

(71) Applicant: COCHRANE USA INC., Alexandria, VA (US)

(72) Inventor: Vlado Bucarizza, Dubai (AE)

(73) Assignee: COCHRANE USA INC., Alexandria, VA (US)

( * ) Notice: Subject to any disclaimer, the term of this patent is extended or adjusted under 35 U.S.C. 154(b) by 718 days.

(21) Appl. No.: 17/487,330

(22) Filed: Sep. 28, 2021

(65) Prior Publication Data

US 2022/0107162 A1 Apr. 7, 2022

(30) Foreign Application Priority Data

Oct. 7, 2020 (ZA) ..... 2020/06200

(51) Int. Cl.
*E04H 17/04* (2006.01)
*B21F 25/00* (2006.01)
*F41H 11/08* (2006.01)

(52) U.S. Cl.
CPC ..... *E04H 17/04* (2013.01); *B21F 25/00* (2013.01); *F41H 11/08* (2013.01)

(58) Field of Classification Search
CPC ..... F41H 11/08; B21F 25/00; B21F 19/00; B21F 15/10; E04H 17/003; E04H 17/004; E04H 17/02; E04H 17/04; E04H 17/045; E04H 17/05; Y10T 428/246; Y10T 428/24702; Y10T 428/24711; Y10T 428/24727; B21D 13/04
See application file for complete search history.

(56) References Cited

U.S. PATENT DOCUMENTS 3,010,701 A * 11/1961 Klemm ..... E04H 17/045 256/2
4,040,603 A * 8/1977 Mainiero ..... F41H 11/08 256/8
4,503,423 A * 3/1985 Mainiero ..... E01F 13/04 340/552
4,509,726 A * 4/1985 Boggs ..... F41H 11/08 256/2
5,401,002 A * 3/1995 Major ..... B21F 25/00 256/2
6,601,830 B1 * 8/2003 Pavlov ..... F41H 11/08 256/2

(Continued)

*Primary Examiner* — Amber R Anderson
*Assistant Examiner* — Kevin J Baynes
(74) *Attorney, Agent, or Firm* — Michael Best & Friedrich LLP

(57) ABSTRACT

A barrier comprising deterrent material including an elongate core wire, and an elongate strip which encloses a part of the core wire, a first elongate portion of the strip which projects as a first elongate flange and a second elongate portion of the strip projects as a second flange, wherein the first flange is formed with a first set of first corrugated formations comprising alternating first channels and first ribs which extend laterally relative to the core and the second flange is formed with a second set of second corrugated formations comprising alternating second channels and second ribs which extend laterally relative to the core, the deterrent material being formed into a plurality of helical coils which extend around a central elongate axis and wherein the first and second flanges extend transversely relative to the elongate central axis.

12 Claims, 5 Drawing Sheets

(56) References Cited

U.S. PATENT DOCUMENTS

| | | | | |
|---|---|---|---|---|
| 6,682,279 | B2 * | 1/2004 | Pessach | F41H 11/10 410/97 |
| 7,325,787 | B1 * | 2/2008 | Gibbs | E04H 17/045 256/2 |
| 7,661,656 | B1 * | 2/2010 | Gibbs | E04H 17/045 256/6 |
| 7,909,309 | B2 * | 3/2011 | Major | E01F 13/022 256/2 |
| 8,851,456 | B2 * | 10/2014 | Kosedag | B21F 25/00 256/8 |
| 10,458,146 | B2 * | 10/2019 | Masserant | E01F 13/028 |
| 10,519,690 | B2 * | 12/2019 | Harrop-Allin | B21F 25/00 |
| 11,447,973 | B2 * | 9/2022 | Samara | E01F 13/02 |

* cited by examiner

DETERRENT MATERIAL

BACKGROUND OF THE INVENTION

This invention relates to a deterrent material.

Certain security requirements call for the use of a flexible barrier to demarcate a restricted area. Typically use is made of a number of helical coils of wire which are longitudinally extended and positioned at a perimeter of the restricted area. This is done with the intention of obstructing or delaying non-authorised persons from gaining access to the area. In some situations security requirements evolve rapidly and consequently there is a need for a self-supporting product which can be positioned at a chosen location, and removed when no longer required, quickly and easily.

In high security applications barriers formed from helical coils of barb wire or razor wire are deployed. These products are potentially dangerous and can harm a person who comes into contact with a barb or spike. To address this aspect barriers comprising helical coils formed from strip material comprising a core wire with flanges on opposing sides of the core wires have been employed. The flanges do not include spikes or barbs and present a continuous flat edge to a person who may come into contact with the flanges. Although this type of barrier reduces the likelihood that a person contacting the barrier will be injured it suffers from a physical weakness in that the individual coils are not particularly stiff and if a person can stand on or otherwise apply a force to a coil there is a likelihood that the core wire and the flanges will be bent and, in this event, one or more coils will be pushed to the ground or collapse. The barrier will then no longer be effective in restricting access to an area which is bounded by the barrier.

SUMMARY OF THE INVENTION

An object of the present invention is to address, at least to some extent, the aforementioned situation.

SUMMARY OF THE INVENTION

The invention provides deterrent material which includes an elongate core wire with a circumference, an elongate strip formed so that a longitudinal section thereof encloses at least a greater part of said circumference whereby a first elongate portion of the strip projects as a first elongate flange to a first side of the core wire and a second elongate portion of the strip projects as a second flange to a second side of the core wire, wherein the first flange is formed with a first set of first corrugated formations comprising alternating first channels and first ribs which extend laterally relative to the core and the second flange is formed with a second set of second corrugated formations comprising alternating second channels and second ribs which extend laterally relative to the core.

Preferably the elongate core is made from steel e.g. high tensile steel. The elongate strip may be made from a more malleable material e.g. a suitable alloy.

The deterrent material may be formed into a plurality of helical coils which extend around a central elongate axis and wherein said first and second flanges extend transversely relative to said elongate central axis. The said first flange may extend from the core wire radially outwardly relative to said central axis and the said second flange may extend from the core wire radially inwardly relative to said central axis.

Each first channel in the first flange may have a depth D1 and each second channel in the second flange may have a depth D2, and D1<D2.

BRIEF DESCRIPTION OF THE DRAWINGS

The invention is further described by way of example with reference to the accompanying drawings in which.

DETAILED DESCRIPTION

Figure 1:
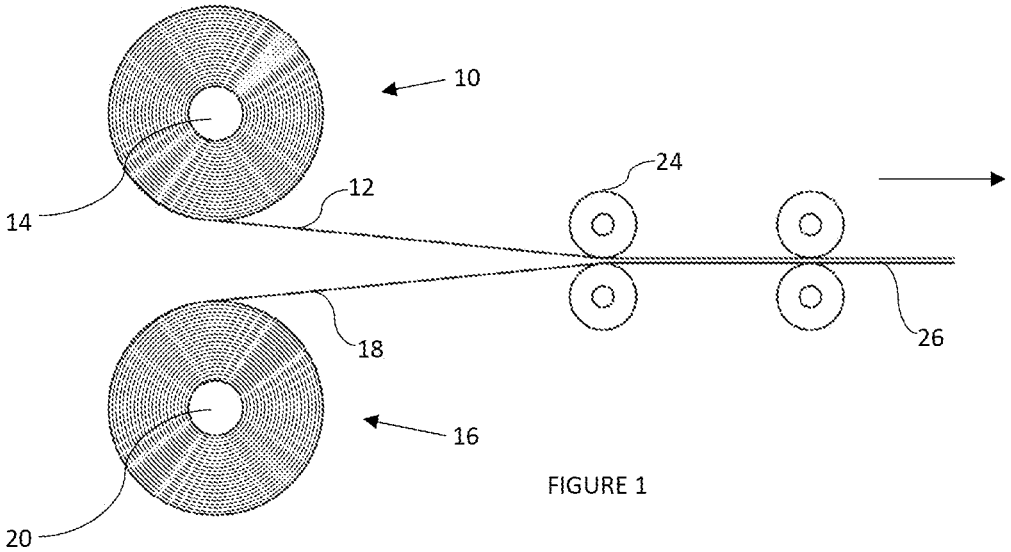
FIG. 1 depicts a first stage in the manufacture of deterrent material according to the invention.
Figure 2:
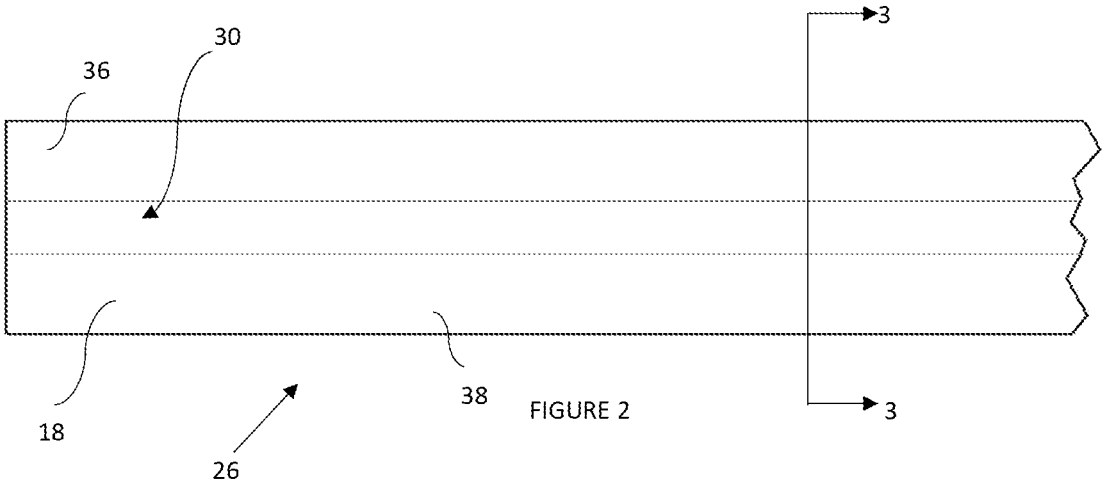
FIG. 2 is a plan view of a product produced by the process shown in FIG. 1.
Figure 3:
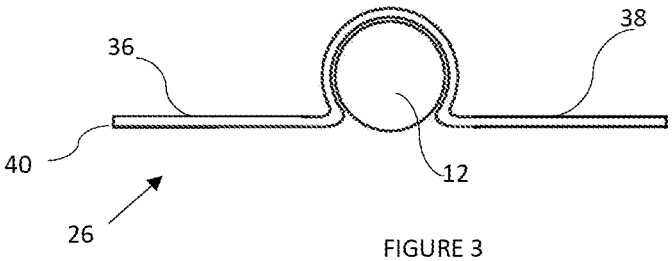
FIG. 3 is a view in cross section of the product shown in FIG. 2 taken on a line 3-3 in FIG. 2.

FIG. 1 of the accompanying drawings illustrates a coil 10 of a high tensile steel core wire 12 mounted for rotation about an axis 14. A coil 16 of an alloy strip 18 is rotatable about an axis 20. The core wire 12 and the strip 18 are drawn by means of machines, not shown, and are passed through one or more sets of rollers 24 to form a product 26 which is shown in plan in FIG. 2 and in cross section in FIG. 3 taken on a line 3-3 in FIG. 2. The rollers 24 are used to deform a central section 30 of the strip 18 so that it extends closely around a greater portion of the circumference of the core wire 12. A first flange 36 extends to one side of the core wire 12 and a second flange 38 extends in an opposing direction on the other side of the core wire. The flanges 36 and 38 are coplanar and smooth. Edges 40 of the flanges are smooth.

Figure 3A:
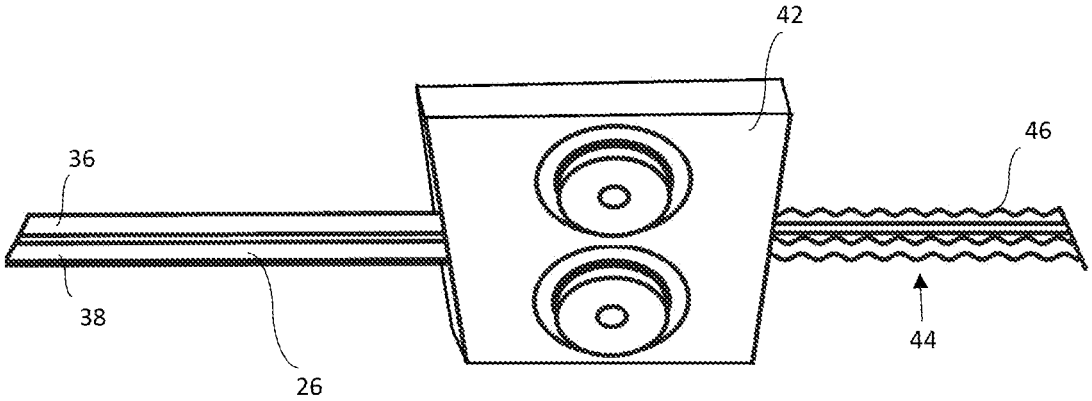
FIG. 3A shows a subsequent ribbing process.
Figure 4:
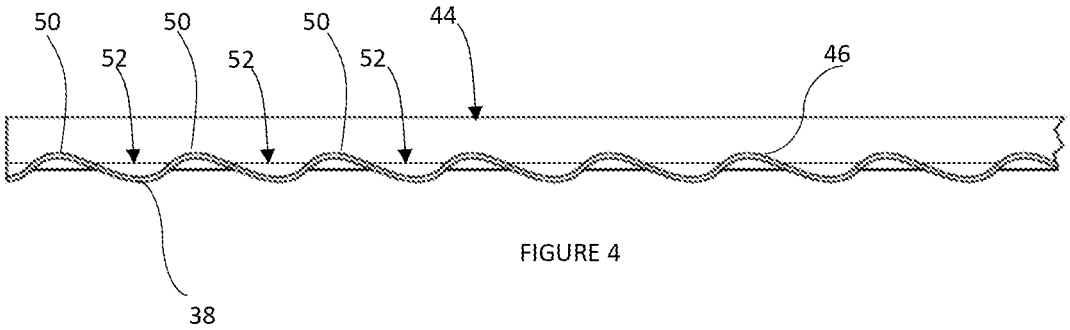
FIG. 4 is a side view of deterrent material produced by the process in FIG. 3A.
Figure 5:
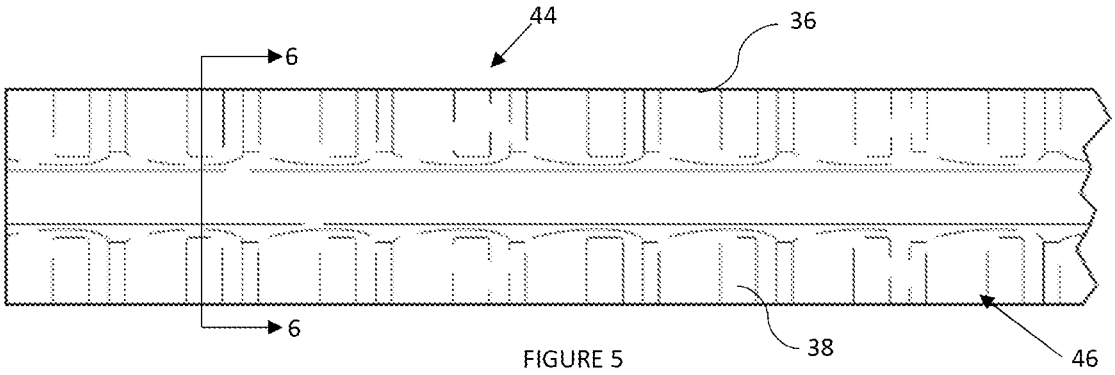
FIG. 5 is a plan view of the deterrent material in FIG. 4.
Figure 6:
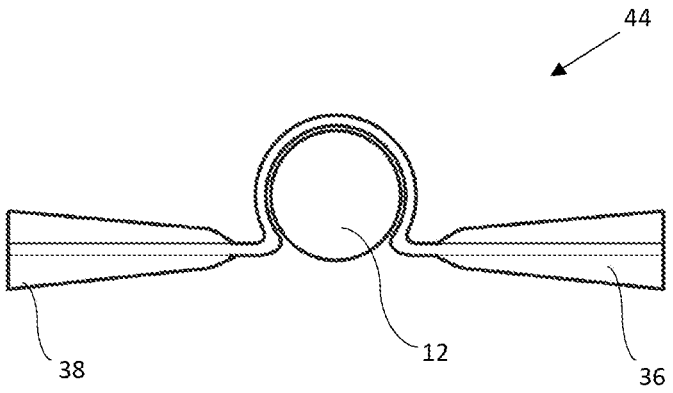
FIG. 6 shows the deterrent material in cross section taken on a line 6-6 in FIG. 5.
Figure 7:
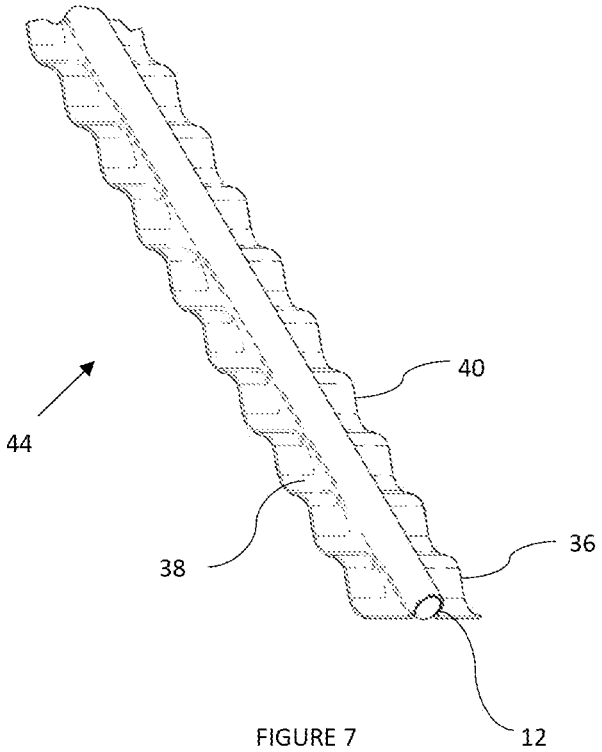
FIG. 7 shows the deterrent material in perspective.

As shown schematically in FIG. 3A the product 26 is then passed through rollers 42, to form a deterrent material 44, according to the invention. Each of the flanges 36 and 38 has a plurality of evenly spaced corrugated formations 46. FIG. 5 shows the material 44 in plan. FIG. 6 shows the material 44 taken on a line 6-6 in FIG. 5. FIG. 4 illustrates from one side the deterrent material 44 and shows the flange 38 with the corrugated formations 46 which comprise a repetitive series of ribs 50 and channels 52. The rib and channel formations 50 and 52 are repeated in each flange 36, 38 along the length of the deterrent material 44. The material 44 is shown in perspective in FIG. 7.

Figure 8:
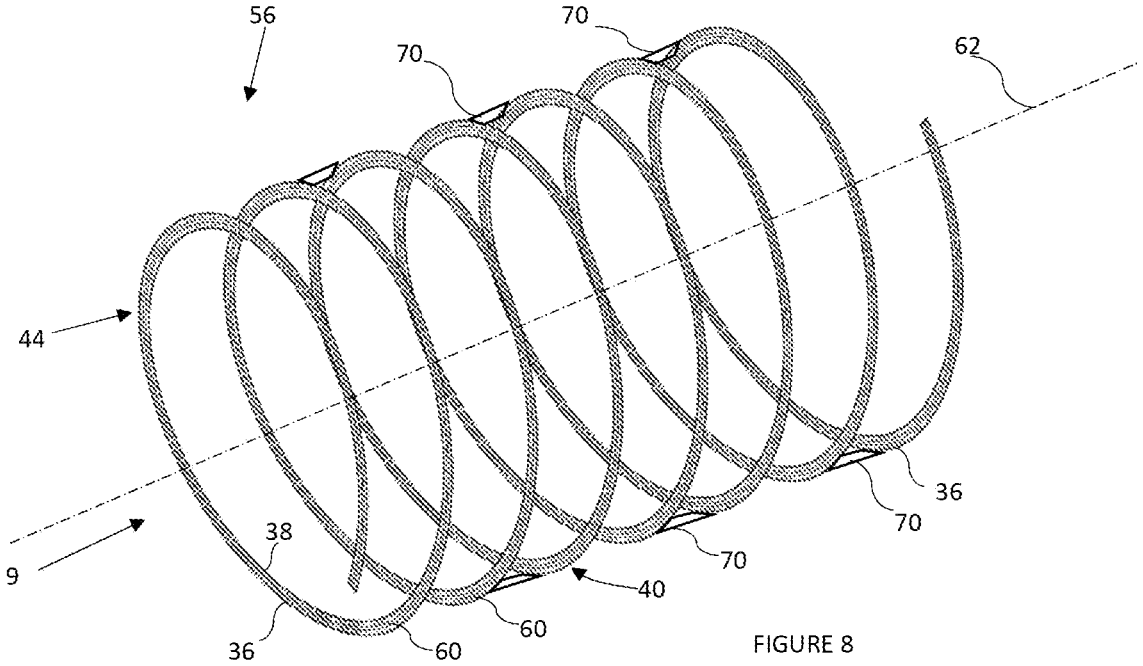
FIG. 8 depicts a portion of a barrier comprising a plurality of helical coils of the deterrent material shown in FIG. 5, formed around a central elongate axis.
Figure 9:
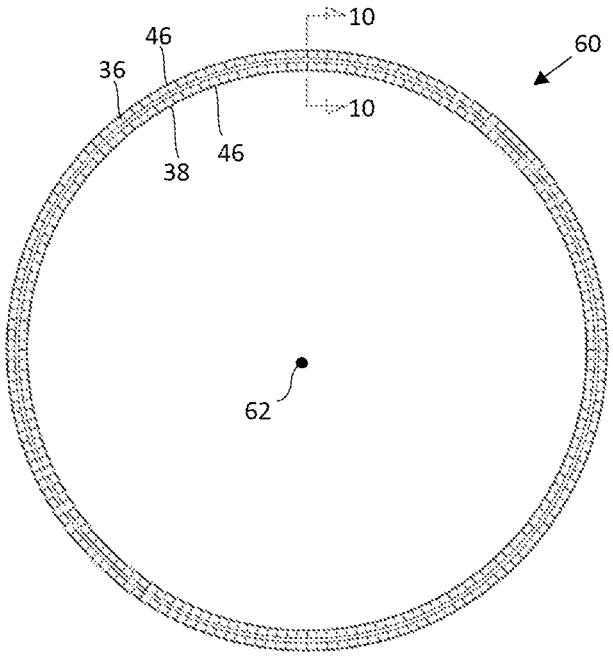
FIG. 9 is a view of the barrier in the direction of an arrow 9 in FIG. 8 and depicts one of the helical coils.

In a subsequent operation an elongate length of the deterrent material 44 is wound into an array 56 of helical coils 60 which are centred on an elongate axis 62—see FIG. 8. In order to stiffen the array 56 each coil 60 is wound in a way which ensures that the flanges 36 and 38 lie in a plane which is at an angle of 90° relative to the axis 62. FIG. 9 illustrates one helical coil 60 when the array 56 is viewed in the direction of an arrow marked 9 in FIG. 8. The flange 36 with the corrugated formations 46 is on a radial outer side of the core wire 12 and the flange 38 with the corrugated formations 46 is on a radial inner side of the core wire 12.

Figure 10:
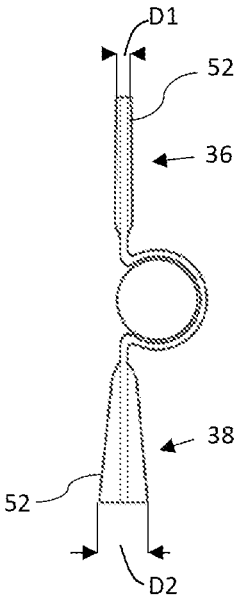
FIG. 10 is a cross sectional view on an enlarged scale of a helical coil taken on a line 10-10 in FIG. 9.

The outer flange 36 travels on a path about the axis 62 which is longer than the path travelled by the inner flange 38. To allow this to take place while still maintaining the flange 36 in a plane which is at a right angle to the axis 62, the corrugations 46 in the flange 36 are extended or stretched in the longitudinal direction of the flange relative to the corrugations 46 in the flange 38. The depth of each channel 52 in the corrugations 46 in the flange 36 is decreased to D1. The depth of each channel 52 in the corrugations 46 in the flange 38 is D2. The result is that D1<D2—see FIG. 10.

At selected locations adjacent coils 60 are tied together by means of strong clips 70, which are notionally indicated in FIG. 8. The arrangement is such that the helical configuration of coils can be collapsed one on the other into a compressed and flat stacked assembly suitable for storage and for transport purposes. On the other hand if the array is to be deployed then one end of the collapsed assembly is anchored and the other end is pulled in the direction of the longitudinal axis 62 so that the coils can take up an operative extended helical configuration in which the coils are spaced apart from one another.

Figure 11:
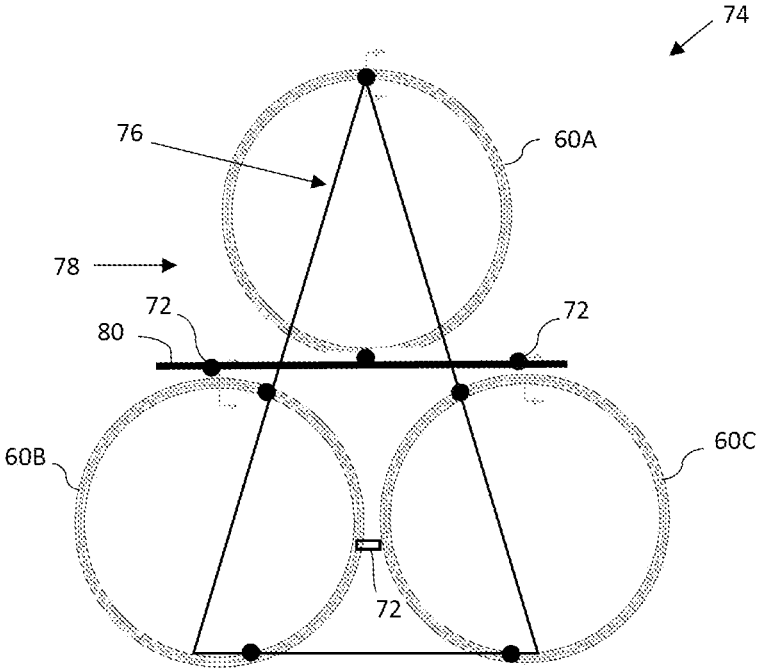
FIG. 11 is an end view of three interconnected barriers. Each of the kind shown in FIGS. 8 and 9.

FIG. 11 shows three helical coils 60A, 60B and 60C which are attached to one another by clips 72 to form a deterrent structure 74. The coils 60B and 60C are side by side and rest on the ground. The coil 60A is positioned above the lower coils 60B and 60C. The formation of the structure is exemplary only and not limiting. The number of coils can be increased or decreased according to requirement. The structure can be heightened (vertically) by stacking additional coils on top of one another.

The coils 60A, 60B and 60C are collapsed into a concertina formation for storage and transport purposes. To facilitate handling of the structure 74 a respective triangular bracket 76 is attached to each end 78 of the deterrent structure 74. Cross bars 80 which are fixed at spaced apart intervals along the length of the structure 74 between the upper coil 60A and the lower coils 60B and 60C help to maintain the coils in the illustrated relative positions when the concertina formation is longitudinally extended. To deploy the structure 74 one end thereof is anchored and the bracket 76 at the other end of the structure is pulled so that the compressed coils 60A, 60B and 60C can take up an extended helical configuration.

The orientation of the flanges 36 and 38 to lie in a plane which is at a right angle to the longitudinal axis 62 means that the helical coils 60, when extended to form a barrier, are substantially stiffened compared to the case in which the flanges 36 and 38 lie on the surface of a cylinder centred on the axis 62 i.e. where the flanges are parallel to the axis 62. As the helical configuration is substantially stiffened a person attempting to flatten the helical coils encounters meaningful resistance. This is not the case if the flanges have the planar configuration referred to.

The use of the alloy, e.g. a mild steel alloy or an aluminium alloy, in the strip has two principal benefits. The alloy is more malleable than steel and the deformation of the corrugations when the deterrent material 44 is formed into the array 56 of helical coils 60 is facilitated. Another benefit is that the edges 40 of the alloy flanges 36, 38 are not as harsh as steel edges. This factor is important in providing a barrier which can act as a physical impediment to prevent access to a restricted area but in such a way that a person contacting a flange is less likely to be injured or hurt by an edge of the flange.

The invention claimed is:

1. A deterrent material comprising:

an elongate core wire with a circumference, an elongate strip formed so that a longitudinal section thereof encloses more than half of said circumference whereby a first elongate portion of the elongate strip projects as a first elongate flange to a first side of the core wire, and a second elongate portion of the elongate strip projects as a second elongate flange to a second side of the core wire, wherein the first flange is formed with a first set of first corrugated formations comprising alternating first channels and first ribs which extend laterally relative to the core wire and the second flange is formed with a second set of second corrugated formations comprising alternating second channels and second ribs which extend laterally relative to the core wire, and wherein the first elongate flange is continuous along the entire length of the elongate core wire.

2. The deterrent material according to claim 1 wherein the elongate core wire is made from high tensile steel and the elongate strip is made from a steel or aluminum alloy.

3. A barrier comprising deterrent material according to claim 2 which is formed into a plurality of helical coils which extend around a central elongate axis and wherein said first and second flanges extend transversely relative to said elongate central axis.

4. The barrier according to claim 3 wherein said first flange extends from the core wire radially outwardly relative to said elongate axis, said second flange extends from the core wire radially inwardly relative to said elongate axis and wherein each first channel in the first flange has a depth D1 and each second channel in the second flange has a depth D2, and D1<D2.

5. The barrier according to claim 4 wherein the helical coils are movable from a compressed configuration in which the coils are located one adjacent another in a direction of said elongate axis to an operative helical configuration at which the coils are spaced apart from one another.

6. A deterrent structure which includes at least first, second and third barriers, each barrier being according to claim 5 wherein the first and second barriers are side by side and rest on the ground, and the third barrier is positioned above and attached to the first and second barriers, the structure including two brackets which are respectively attached to opposed ends of the barriers to facilitate handling thereof.

7. The deterrent structure according to claim 6 which includes a plurality of cross bars which are fixed at spaced apart intervals along a length of the barriers between the third barrier and the first and second barriers, to maintain the barriers in their relative positions.

8. The deterrent material of claim 3 wherein the second elongate flange is continuous along the entire length of the elongate core, such that when formed into a plurality of helical coils, the first and second elongate flanges are unbroken around the plurality of helical coils.

9. The barrier of claim 3 wherein the first elongate flange extends a first length along a first path along an outer circumference of the core wire, and the second elongate flange extends a second length along a second path along an inner circumference of the core wire, such that the first length is longer than the second length.

10. The deterrent material of claim 1 wherein the second elongate flange is continuous along the entire length of the elongate core wire.

11. The deterrent material of claim 1 wherein the first channels and the first ribs alternate in a direction parallel to the elongation of the core wire and wherein the second channels and the second ribs alternate in a direction parallel to the elongation of the core wire.

12. The deterrent material of claim 1 wherein the first channels and the first ribs alternate along the entire length of the core wire and wherein the second channels and the second ribs alternate along the entire length of the core wire.

* * * * *